United States Patent [19]

Bisson et al.

[11] Patent Number: 4,905,616

[45] Date of Patent: Mar. 6, 1990

[54] ASSEMBLING DEVICE FOR FABRIC LAYERS FOR INDUSTRIAL MACHINES

[75] Inventors: Flavio Bisson, Cava Manara; Piero Negri, Pavia, both of Italy

[73] Assignee: Necchi Societa' per Azioni, Pavia, Italy

[21] Appl. No.: 330,786

[22] Filed: Mar. 30, 1989

[30] Foreign Application Priority Data

Jun. 7, 1988 [IT] Italy ..... 42906 A/88

[51] Int. Cl.[4] ..... D05B 21/00

[52] U.S. Cl. ..... 112/121.12; 112/121.15; 112/306

[58] Field of Search ..... 112/121.12, 121.15, 112/121.11, 153, 306

[56] References Cited

U.S. PATENT DOCUMENTS

| | | | |
|---|---|---|---|
| 1,092,068 | 3/1914 | Gerber | 112/121.12 |
| 1,215,677 | 1/1918 | McDonald | 112/121.12 |
| 3,034,458 | 5/1962 | Bennison | 112/121.12 |
| 3,172,379 | 3/1965 | Light | 112/121.15 X |
| 4,407,208 | 10/1983 | Meyer | 112/121.12 |
| 4,485,754 | 12/1984 | MacDonald | 112/121.15 X |
| 4,510,876 | 4/1985 | Garley et al. | 112/121.12 X |

*Primary Examiner*—H. Hampton Hunter

*Attorney, Agent, or Firm*—Stevens, Davis, Miller & Mosher

[57] ABSTRACT

An assembling device for fabric layers of simple construction providing two plates connected to each other, one of which carries a plurality of needles and the other of which has a series of corresponding holes. The two plates may be brought near to each other, so that the needles jut out from the holes for transfixing the fabric layers, and may be removed so that the plate with the holes slips off the fabric layers from the needles. A locking mechanism is provided with locks, in an unlockable way, the two plates in their approached position.

19 Claims, 5 Drawing Sheets

ASSEMBLING DEVICE FOR FABRIC LAYERS FOR INDUSTRIAL MACHINES

DISCLOSURE OF THE INVENTION

The present invention relates to an assembling device for fabric layers, particularly designed for industrial machines.

In the manufacturing industry there is the necessity of assembling and overlapping fabric layers. In forming a collar or a cuff of a shirt, for example, three fabric layers are used, which must be singly drawn and thus overlapped, in order to be transferred to the sewing unit and sewn together. For this purpose, grasp members may be used, at present, which present a grasp head comprising a small wheel and a block opposed to the small wheel. For grasping the fabric layer, the small wheel and the block are carried into contact with this and then the small wheel is rotated in one direction so that a fabric strip is grasped between the same small wheel and the block.

For discharging the fabric layer, the small wheel is rotated in the opposite direction. There are even different grasping heads, formed for example by pick-up pliers. The drawback to be noted is due to the fact that for grasping fabric layers having a certain longitudinal extension, as in forming shirt collars, two of such grasping members are necessary, which operate at two opposite points of the layer, because only one of these members at a time keeps in a plane configuration, as the fabric layers transfer and release on the sewing unit. Further, such grasping members are already very complex and moreover require also for their accomplishment and their displacement complex mechanisms.

Their utilization thus requires not insignificant costs. The object of the present invention is to provide an assembling device, capable of drawing and overlapping fabric layers, which is simple and cheap.

This object is attained by means of an assembling device for fabric layers, particularly designed for industrial machines, characterized by the fact that it comprises two principal elements connected in such a way that they may freely move reciprocally between a removal position and an approach position. One of the principal elements carries solidly a plurality of needles and the other defines a plurality of holes in correspondence with the needles. In the removal position the needles are gathered in a space included between the two principal elements. In the approach position the needles are positioned in the holes and jut out from them. Locking means are provided which lock, in an unlockable way, the principal elements in the approach position, during the passage from the removal position to the approach position. The needles jut out gradually from the corresponding holes for transfixing the fabric layers, while during the passage from the approach position to the removal position the principal element provided with the holes slips off the fabric layers from the needles.

Figure 1:
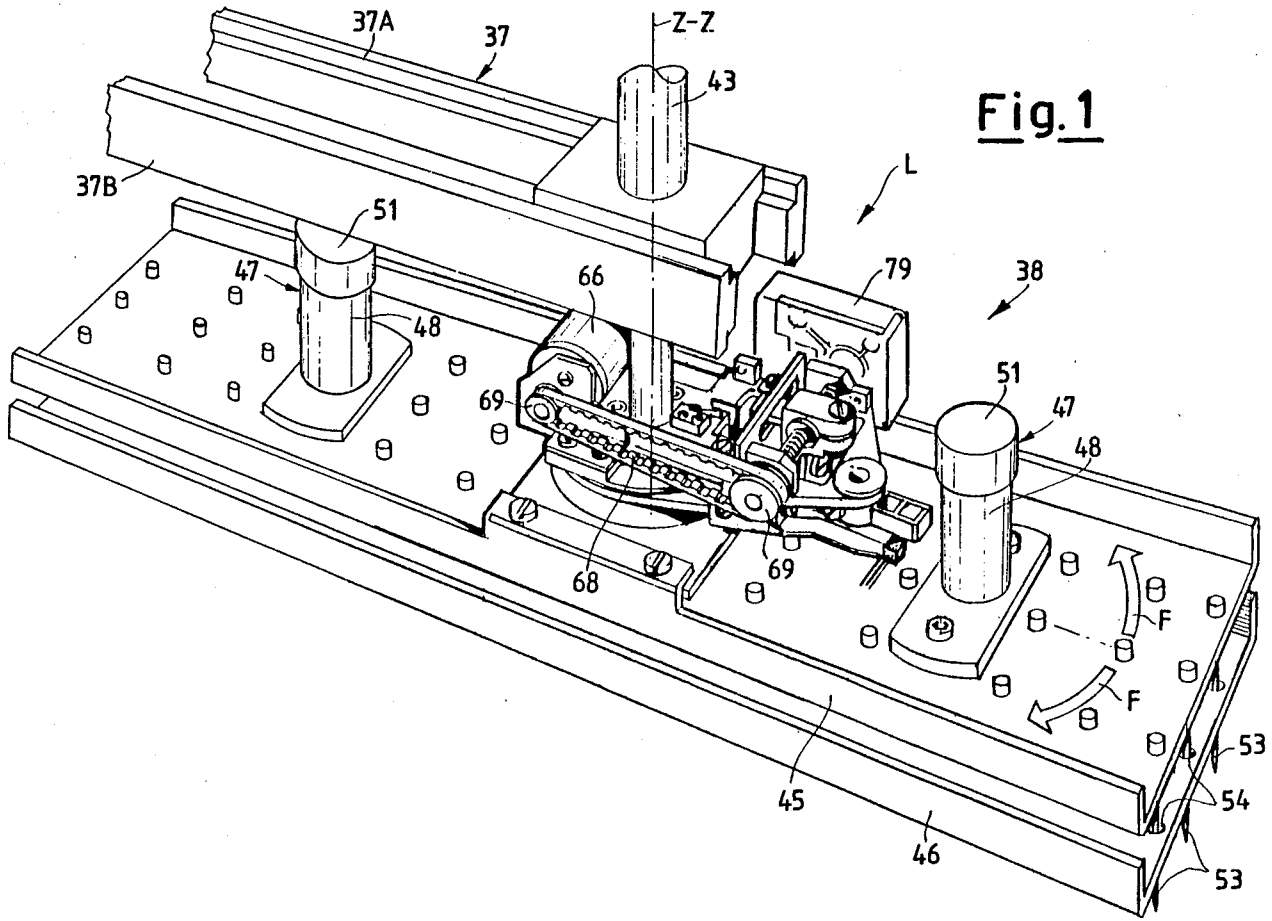
Figure 2:
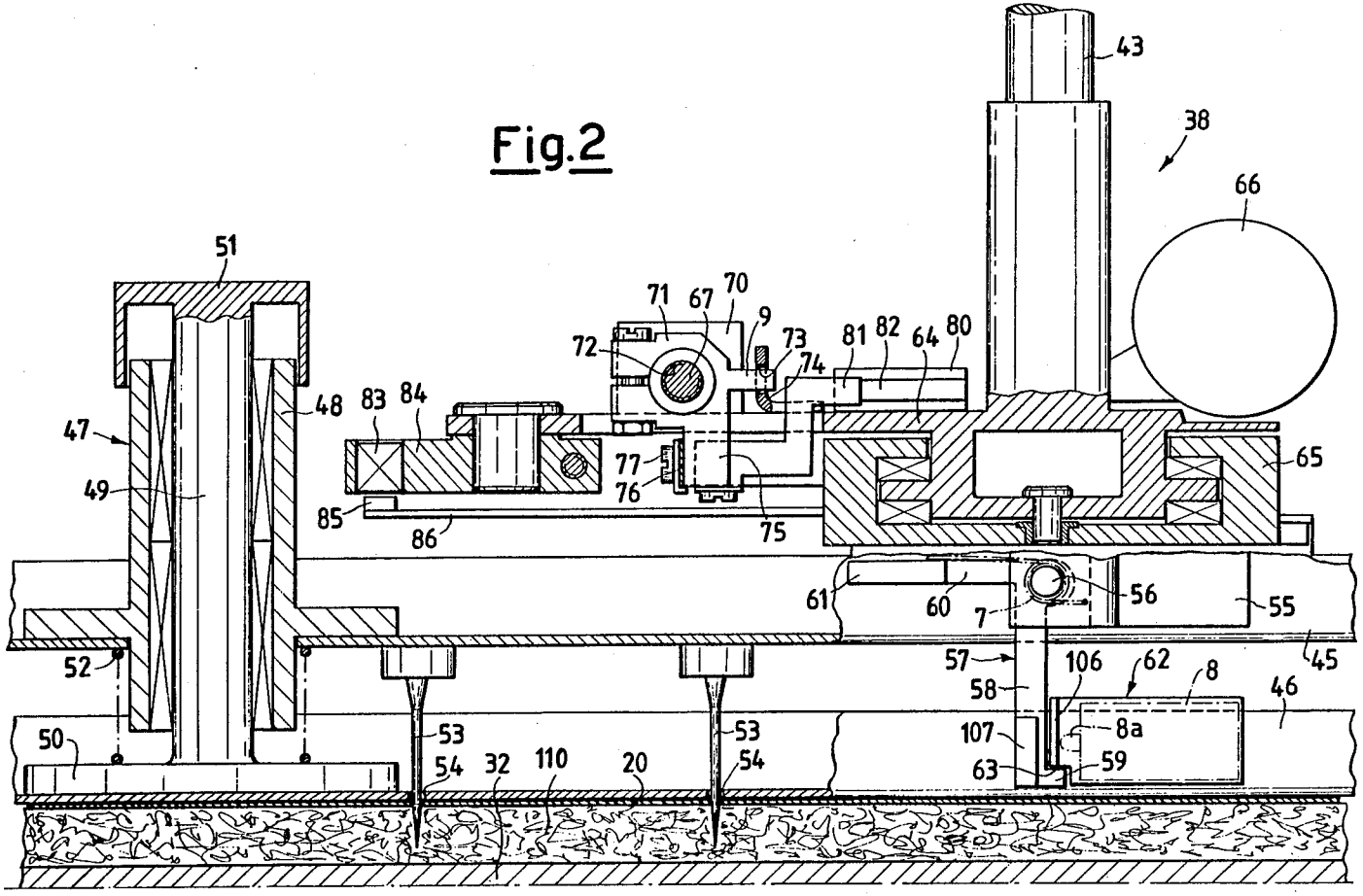
Figure 3:
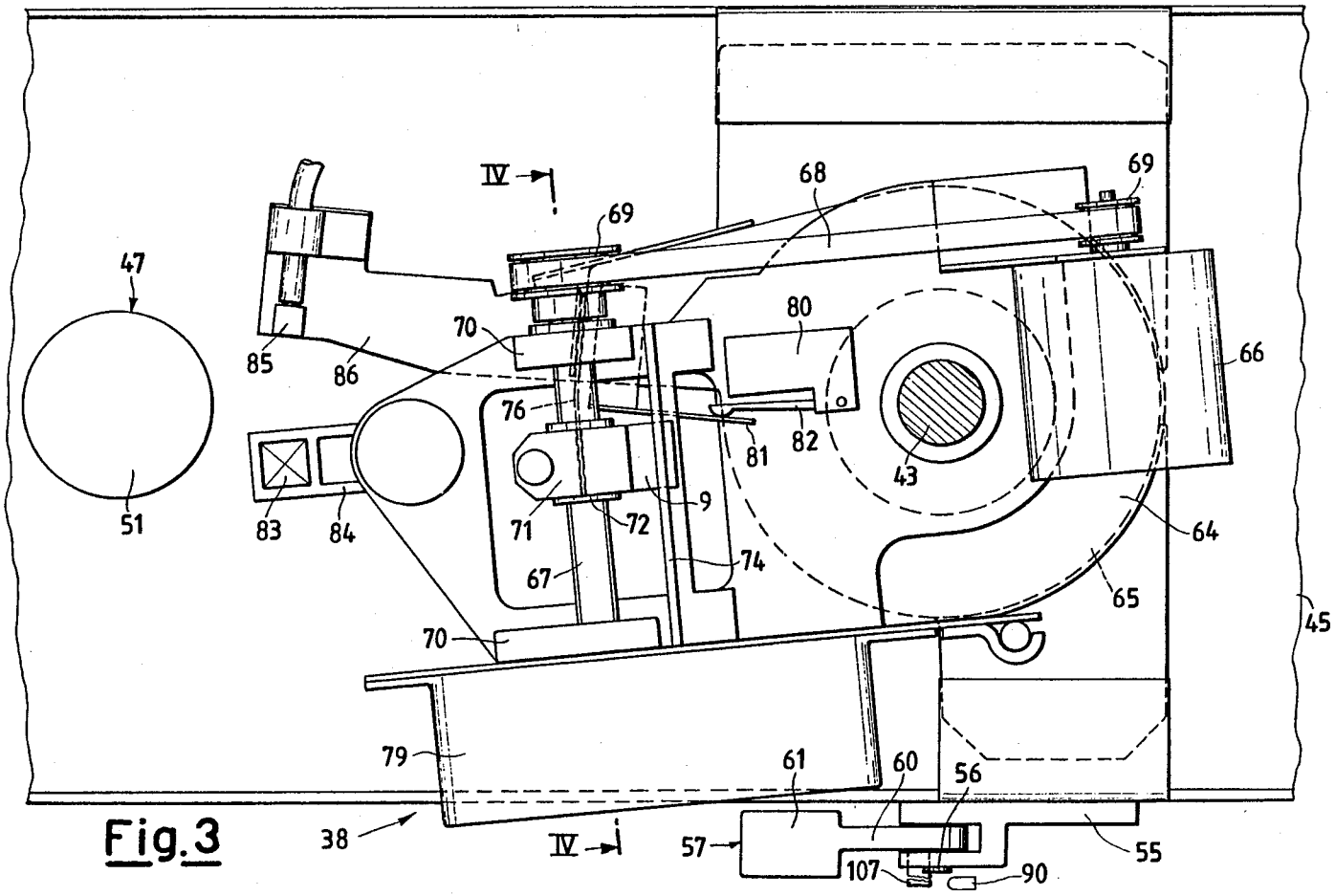
Figure 4:
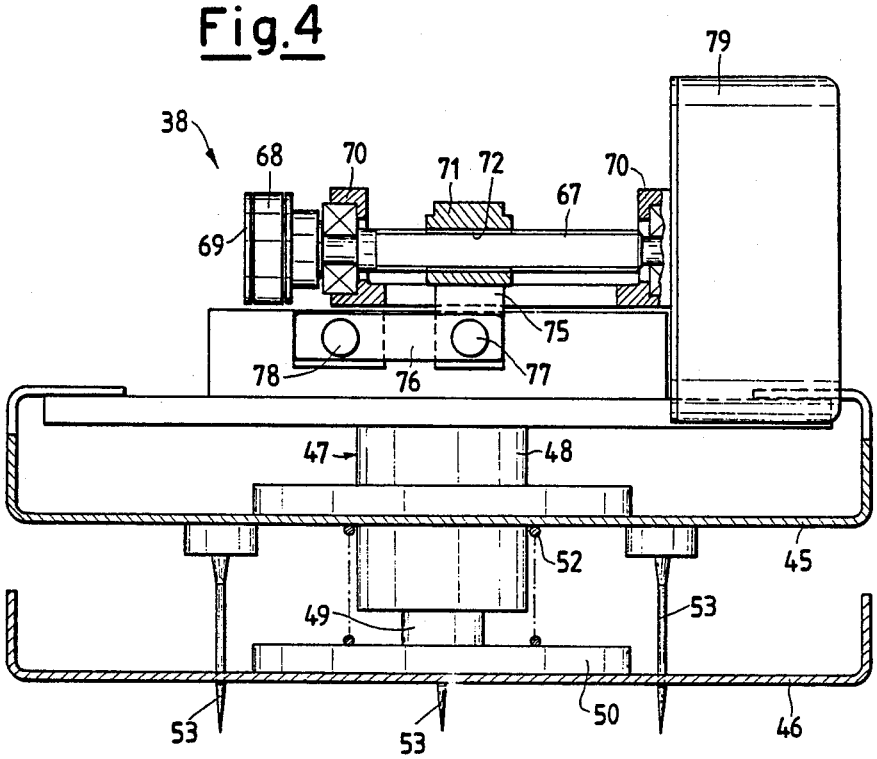
Figure 5:
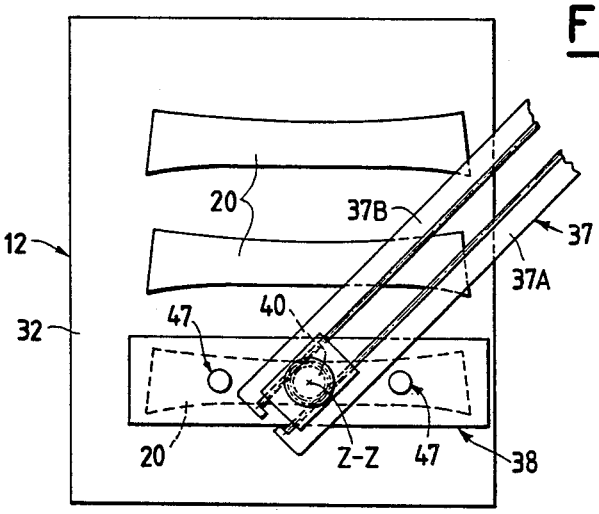

Other details and features of the invention will stand out from the description given below by way of non-limitative example and with reference to the accompanying drawings, in which:

FIG. 1 is a perspective view of an assembling device according to the invention, FIG. 2 is a partial side view looking in the direction of arrow L, partially in section, of the assembling device of FIG. 1, FIG. 3 is a partial plan view of the assembling device of FIG. 1, FIG. 4 is a section taken along line IV-IV of FIG. 3 of the device of FIG. 1, FIG. 5 shows a plan view of the operating way of the assembling device of FIG. 1.

Figure 6:
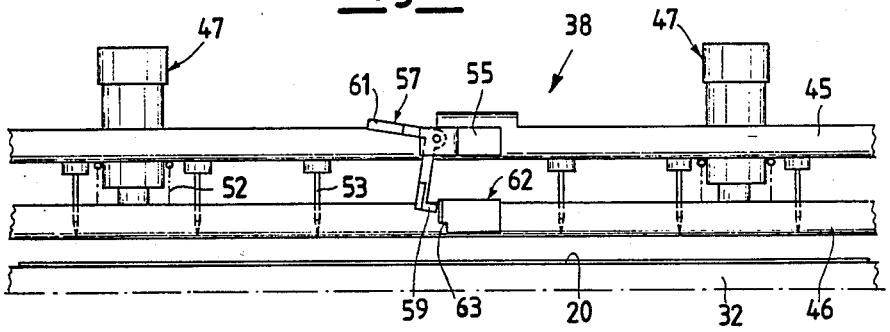
Figure 7:
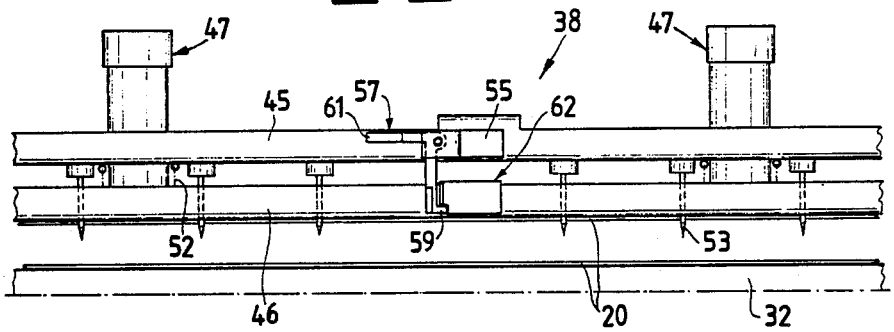
Figure 8:
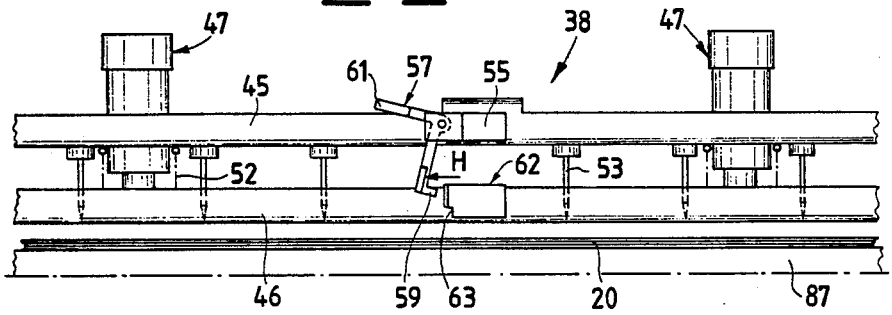

FIGS. 6, 7 and 8 show a side view of the operating way of the assembling device of FIG. 1.

Referring to the FIGS. 1, 2, 3, 4 an assembling device for fabric layers, altogether indicated with 38, comprises two principal elements formed by two parallel plates 45 and 46 connected to each other by two connecting members 47. Each connecting member comprises a bushing 48 in which a column 49, provided with a foot 50 and a head 51, is mounted, free to slide. The bushing 48 is fixed to the plate 45, while the foot 50 is fixed to the plate 46. The connecting members 47 permit a relative approach and removal movement of the two plates 45 and 46 maintaining the parallelism between them. Around each bushing 48, between the two plates 45 and 46, a helicoidal spring 52 is mounted, which acts at one side on a surface of the plate 45 and at the other side on the foot 50 so as to maintain elastically spaced the two plates 45 and 46. The heads 51 are end-stroke elements and maintain the two plates 45 and 46 in a determinate position of greatest reciprocal distance against the action of the spring 52. On the underside of plate 45 a plurality of needles 53 are fixed. In correspondence with the needles 53, there are on the plate 46 an equal number of holes 54, through which the needles pass in determinated reciprocal positions of the two plates 45 and 46. On a folded edge of the plate 45 there is mounted a bracket element 55 to which a hook 57 is pivoted at 56. The hook 57 is L-shaped and has on the end of one of its arms 58 a locking tooth 59, while the other arm 60 presents at its end a counterweight 61. On a folded edge of the plate 46 there is fixed a L-shaped referement element 62 which presents a notch 63 into which the locking tooth 59 is designed to set.

The assembling device 38 comprises a rod 43 connectable to a driving unit, non illustrated and which is rotating around its longitudinal axis Z-Z. For the rotation of the assembling device around the Z-Z axis, the rod 43 ends in a anchorage foot 64 which couples, free to rotate, with a hollow element 65 fixed to the plate 45. An electric motor 66 is mounted on the foot 64 and transmits rotative motion to a screw 67 via a toothed belt 68 and two toothed wheels, one of them a driving wheel fixed to the motor shaft, the other, a driven wheel fixed to the screw 67. The screw 67 is mounted, free to rotate, on two abutments 70 fixed to the foot 64. On the screw 67 there is mounted a block 71 in which a nut screw is made out, coupling with the screw 67. The block 71 is provided with a tongue 9 which is placed, free to slide, in a slot 73 of an element 74 fixed to the foot 64. A free end of a flexible blade 76 is fixed to an extension 75 of the block 71. The other end of the flexible blade 76 is fixed to the hollow element 65. In this way, at one rotation of the screw 67, operated by the motor 66, block 71 is displaced along the axis of the screw, the displacement being guided by the slot 73. In turn the block 71 rotates the hollow element 65 by means of the blade 76. The fact that the junction 77 of the blade 76 to the extension 75 of the block 71 moves with rectilinear motion and the junction 78 of the blade 76 to the hollow element 65 moves with circular motion is compensated for by the flexibility of the same blade which will bend more or less according to the position of the junction 77 with respect to the rotation center of the junction 78. By an appropriate supply of the electric motor 66 it is possible to cause the rotation of the hollow element 65 relatively to the anchorage foot 64, that is to cause the rotation of the whole assembling device 38 around the Z—Z axis, along which the rod 43 is placed, in one or in the other of the two rotation ways, indicated by the arrow F in FIG. 1.

An angular position sensor of known type, connected to the screw 67, is also fixed to the foot 64. Moreover there are provided two stroke-ends which stop the rotation of the assembling device 38 in two respective angular positions relative to the Z—Z axis, that is they limit the angular excursion of the assembling device 38. One stroke-end is relative to one rotation way while the other stroke-end is relative to the other rotation way. One of the two stroke-ends is formed by a microswitch 80, fixed to the foot 64, which is controlled by a blade 81, fixed to the block 71, which acts on a small rod 82 of the microswitch 80 controlling the mobil contact of the same microswitch, which gives the command to stop the stroke. The other stroke-end is formed by an electronic switch comprising a magnet 83, mounted on extension 84 of the anchorage foot 64, and a transistoric circuit 85 mounted on an extension 86 of the hollow element 65 in correspondence of the magnet 83. When the circuit 85 is aligned with the magnet 83, this last alignment determines a commutation in the same circuit which gives the command to stop the stroke.

In the FIGS. 5, 6, 7, 8 there is shown the operating way of the assembling device 38 with reference to the particular utilization of this device for the assembling of three fabric layers resting, in separate positions one from another, on a support plane 32. In FIG. 5, as well as in FIG. 1 there is partially illustrated an arm 37, formed by two half-arms 37A and 37B, of the above cited driving unit which supports the assembling device 38.

Supposing that the assembling device 38 is in raised position with respect to the support plane 32, then the driving unit moves the arm 37 to carry the assembling device 38 to a correct position above the lower fabric layer 20 (FIG. 5). Then the driving unit acts on the rod 43 and controls the descent of the assembling device 38 towards the support plane 32. Before the assembling device 38 is lowered by the driving unit for assembling the first fabric layer 20, it is in the configuration of FIG. 6, in which the two plates 45 and 46 are elastically kept apart by the springs 52 in a position in which the needles 53 are completely inside the space delimited by the same plates and in which the tooth 59 of the hook 57 is kept by the counterweight 61 against a wall 106 of the element 62. When the lower plate 46 enters into contact with the support plane 32 and with the first fabric layer 20, the further descent of the assembling device 38 causes the approach of the plate 45 to the plate 46 against the action of the spring 52 and, as a consequence, causes the partial extension of the needles 53 through the corresponding holes 54. In this way the needles transfix the fabric layer 20 and partially enter into the support plane 32, as shown in FIG. 2. Subsequently the driving unit controls the raising of the assembling device 38 via the rod 43. During the raising, the biasing action of the spring 52 tends to separate, again the two plates 45 and 46; yet the tooth 59 of the hook 57 sets into the cavity 63 of the element 62, that is the hook 57 clasps the element 62 fastening the two plates 45 and 46 in an approached position in which the needles jut out of the corresponding holes 54 keep the fabric layer 20 transfixed, which is so raised with the assembling device 38, as shown in FIG. 7. In the following phase, the assembling device 38 is carried in the correct position above the central fabric layer 20 and is lowered and raised so that the needles 53 transfix and carry with them evenly the second fabric layer. The hook 57 is always kept by the counterweight 61 in locking position so the needles are kept always in jutting out position.

The following phase is the assembling of the third superior fabric layer 20, which occurs in the identical way explaned in the previous phase. The three fabric layers 20 result in this way being transfixed by the needles 53 and laid one upon the other.

The support plane 32 provides a fibrous superior thickness 110, shown only in FIG. 2, which permits a partial penetration of the needles 53 into the same plane during the assembling of the fabric layers 20 without creating friction forces which could obstruct the raising of the assembling device 38. At the moment the driving unit moves the assembling device 38 with the three laid upon fabric layers 20 transfixed by the needles 53, until it is carried on a support base 87 for the discharge of the three laid upon fabric layers 20 on the same base. This support base may, for example, be part of a sewing unit where the three laid upon fabric layers 20 are sewn together. When the assembling device is in its correct position on the support base 87, the hook 57 of the element 62 is unlocked. The unlocking of the hook causes the action of the spring 52, to suddenly remove the plate 46 from the plate 45 to its greatest removal position so that the inferior plate 46 slips off the three laid upon fabric layers 20 from the needles 53 and pushes them towards the support base 87, where such fabric layers are stored, as shown in FIG. 8. In the figure the unlocking movement of the hook 57 is schematized with an arrow "H". The assembling device returns into this way in the position of FIG. 6. For unlocking the hook 57, unlocking means associated with the same hook may be used.

For example it may be considered a small hammer, mounted on the support base, schematically indicated by 90 in FIG. 3, which is driven by a pneumatic or electromagnetic actuator in such a way as to strike against the hook 57 for unlocking it from the element 62. It may be even considered a pneumatic or electromagnetic member directly mounted on the assembling device, as shown in FIG. 2, where this unlocking member, mounted on the plate 46, is illustrated in phantom lines and indicated with 8 and comprises an element 8A which operates as a small hammer.

Generally. the unlocking means may be of any type and may be mounted on the assembling device or on the structure which receives the three laid upon fabric layers. The described and illustrated assembling device appears in its more basic structure, that is not considering the motor and the kinematic elements which permit its rotation around the Z-Z axis, very simple as it is formed by few and elementary components. This involves then a very low production cost. Even the operating way of this assembling device is very simple so that to make the same device very reliable. Moreover it maintains the fabric layers laid upon in a plane configuration during the transport and in the discharge. It may besides other functions, draw and lay upon a different number of fabric layers, as well as fabric layers of various form, size, tickness etc.

Considering the members which permit the rotation of the assembling device around the Z—Z axis, they permit a very fine rotation movement, due to the great reduction operated by the screw 67. This is important for setting the correct angular position of the assembling device above the fabric layer to be drawn, as often in the driving operation it is just this angular regulation that is the most important. Often the driving units are missing in this angular regulation and are necessary especially when the piece to be drawn is of oblong configuration. It is clear that variations and/or supplements may be provided to what was before described and illustrated.

For example the configuration of the plates, in respect to the form of the fabric layers, may be changed and even the type of the connecting members may be changed.

As far as the rotation of the assembling device is concerned, this could be effected by rotating directly the same assembling device. It is to say, however, that the illustrated solution consisting in mounting a small electric motor and the corresponding kinematic elements on the assembling device for rotating this device relatively to one of its rods which permits its connection to the driving unit, is particularly effective in order to relieve as much as possible the load supported by the driving unit.

Clearly, the kinematic elements above described and illustrated, which permit the electric motor to rotate the assembling device as regards to its connection rod, may be replaced by kinematic elements having equivalent functions.

The kinematic elements of the present invention however are particularly advantageus because they do not require an electric motor of relatively great power, and thus heavy in weight, for rotating the assembling head, due to the great reduction effected by the screw 67 and because, always due to this reduction, permit a fine regulation of the rotation of the assembling head. Instead of the counterweight 61, it is possible to use, for keeping the hook against the corresponding element to which it couples, a spring schematically indicated in FIG. 2 in phantom lines with 7.

Such assembling device, even though is particularly apt for assembling and laying upon fabric layers, it may also assemble layers of other material which may be easily transfixed and slip off the needles.

What is claimed is:

1. Assembling device for fabric layers, particularly designed for industrial machines, comprising first and second principal elements connected by means in such a way that they may freely move reciprocally between a removal position and an approach position, said first principal element carrying fixed thereto a plurality of needles and said second principal element defining a plurality of holes in correspondence with said needles, in the removal position said needles being gathered in a space included between said two principal elements, in the approach position said needles extending into and through said holes, releasable locking means which lock said first and second principal elements in said approach position, during the passage from said removal position to said approach position said needles jutting out of from said holes for transfixing said fabric layers, while during the passage from said approach position to said removal position said second principal element provided with the holes slipping off the fabric layers from said needles.

2. Assembling device according to claim 1, wherein elastic members are interposed between said first and second principal elements, said members biasing said first and second principal elements in said reciprocal removal position.

3. Assembling devices according to claim 1, wherein said connection means include a stem-bushing coupling which permits said reciprocal mobility between said first and second principal elements.

4. Assembling device according to claim 1, means to dispose said first and second principal elements parallel to each other and move reciprocally maintaining said parallelism.

5. Assembling device according to claim 1, wherein said locking means comprise a hook connected to said first principal elements and a referement element connected to said second principal elements, said hook being movable between an unlocking position when said principal elements are in reciprocal removal position and a locking position when said principal elements are in a reciprocal approach position.

6. Assembling device according to claim 5, including means acting on said hook for locking it with said referement element in the reciprocal approach position of the first and second principal elements carrying the hook in the locking position.

7. Assembling device according to claim 6, wherein said means acting on said hook comprise a counterweight.

8. Assembling device according to claim 6, wherein said means acting on said hook comprise an elastic member.

9. Assembling device according to claim 5, including means for pivoting on said first principal element for oscillating between the unlocking position and the locking position.

10. Assembling device according to claim 1, including unlocking means for said locking means.

11. Assembling device according to claim 1, including connecting means connected to said assembling device and connectable to a driving unit.

12. Assembling device according to claim 11, including means for the relative rotation of the first and second principal elements of the assembling device with regard to the connecting means.

13. Assembling device according to claim 12, including kinematic elements and motor means fixed to said connecting means and connected to said first and second principal elements through said kinematic elements for permitting the rotation of said first and second principal elements with regard to said connecting means.

14. Assembling device according to claim 13, including a flexible element and wherein said kinematic elements comprise a screw rotatably mounted on said connecting means and moreover a further element screw coupled with said screw for movement with rettilinear motion as the screw rotates, said further element being connected via said flexible element to said first principal element.

15. Assembling device according to claim 14, including an angular position sensor mounted on said connecting means and rotatably connected to said screw.

16. Assembling device according to claim 12, including end-stroke members for delimiting the angular rotation of the first and second principal elements.

17. Assembling device according to claim 1, wherein each of said first and second principal elements is formed by a plate.

18. Assembling device according to claim 1, including unlocking means and wherein said locking means are joined with said unlocking means disposed on a structure outside the same assembling device.

19. Assembling device according to claim 1, including an assembling plane joined to said assembling device on which the fabric layers are posed, said assembling plane presenting a fibrous support thickness.

* * * * *